United States Patent [19]

Ross

[11] Patent Number: 4,825,623

[45] **Date of Patent: * May 2, 1989**

[54] CYCLICALLY OPERABLE APPARATUS FOR FORMING AND FILING BAGS

[75] Inventor: Graham J. Ross, Hingham, Mass.

[73] Assignee: Pneumatic Scale Corporation, Quincy, Mass.

[ * ] Notice: The portion of the term of this patent subsequent to Jan. 12, 2005 has been disclaimed.

[21] Appl. No.: 143,076

[22] Filed: Jan. 12, 1988

Related U.S. Application Data

[63] Continuation-in-part of Ser. No. 892,375, Aug. 4, 1986, Pat. No. 4,718,217.

[51] Int. Cl.[4] ..... B65B 9/08; B65B 1/22; B65B 57/10

[52] U.S. Cl. ..... 53/437; 53/451; 53/525; 53/551; 53/75

[58] Field of Search ..... 53/525, 529, 503, 504, 53/551, 552, 550, 437, 438, 451, 55, 75; 493/302

[56] References Cited

U.S. PATENT DOCUMENTS

| | | | |
|---|---|---|---|
| 2,655,777 | 10/1953 | Hagen | 53/55 X |
| 3,296,770 | 1/1967 | Wilson | 493/302 X |
| 3,983,682 | 10/1976 | Scully . | |
| 4,018,029 | 4/1977 | Safranski et al. | 53/551 X |
| 4,019,547 | 4/1977 | Ross | 52/525 X |
| 4,040,230 | 8/1977 | Pressel et al. | 53/504 X |
| 4,043,098 | 8/1977 | Putnam, Jr. et al. | 53/551 |
| 4,407,108 | 10/1983 | Craig | 53/551 X |
| 4,514,959 | 5/1985 | Shroyer | 53/552 X |
| 4,520,615 | 6/1985 | Engler et al. | 53/550 |
| 4,548,286 | 10/1985 | Sashiki et al. | 53/503 X |
| 4,571,926 | 2/1986 | Scully | 53/552 X |
| 4,597,240 | 7/1986 | Scully | 53/552 X |
| 4,718,217 | 1/1988 | Ross | 53/525 X |

*Primary Examiner*—Horace M. Culver
*Attorney, Agent, or Firm*—Robert T. Gammons

[57] ABSTRACT

Apparatus for forming bags of predetermined length with a predetermined weight of product, the apparatus being provided with a vibrator for effecting vibration of a bag shaper and a sensor adjacent the bag shaper for determining when the product has subsided to a level less than the height of the bag so that jaws may be engaged to seal the top of the bag without being jammed by product.

12 Claims, 2 Drawing Sheets

CYCLICALLY OPERABLE APPARATUS FOR FORMING AND FILING BAGS

BACKGROUND OF THE INVENTION

This is a continuation-in-part of copending U.S. application Ser. No. 892,375 filed 8-4-86 which wlll issue as U.S. Pat. No. 4,718,217, on Jan. 12, 1988.

The invention disclosed in my parent patent is a cyclically operable apparatus for depositing predetermined weights of product into bags, sealing the bags and dropping them into cartons. The apparatus as disclosed in the aforesaid application comprises a forming tube on which sheet material is formed into bags, sealing and severing jaws for forming a seal at the lower end of the bag on the forming tube, means for depositing a predetermined weight of product in the forming tube, means for retracting the jaws after the product is deposited in the forming tube and lowering the bag between the retracted jaws into shaping means below the jaws to thus receive the product from the forming tube and means for thereafter closing the jaws to seal the upper end of the bag and sever it from the succeeding bag to allow the filled bag to drop from the shaping means into a carton supported therebelow. As shown therein, there is means for vibrating the product while in the forming tube so that when the bag is lowered into the shaping means, the product will be below the jaws. The apparatus is operated cyclically and, as shown therein, there is sensing means for detecting the level of the product in the forming tube and if it exceeds a tolerable fill level, interrupting the cycle of operation and effecting operation of the means for vibrating the product within the forming tube. There is also means operable when the level of the product within the forming tube subsides to a level commensurate with the length of the bag to abort the operation of the vibrating means and resume operation of the cycle of operation.

It is the purpose of this invention to provide as an improvement over the aforesaid apparatus means for, on the one hand, extending operation of the vibrating means associated with the forming tube into the succeeding cycle of operation in anticipation of an excess volume of product occurring in the succeeding cycle of operation and, on the other hand, lowering the filled bag from the forming tube into the shaping means and if the level is above the jaws, interrupting the cycle of operation and preventing the jaws from closing until product clears away from a height extending between the jaws. The shaping means is vibrated to settle the product beneath the jaws. Vibration associated with the forming tube and/or the shaping means may be continuous or controlled by the sensors.

SUMMARY OF THE INVENTION

As herein illustrated, there is a forming tube in which product is deposited, means for forming a bag on the forming tube, sealing jaws at the lower end of the forming tube for sealing the bag at its lower end and a shaping means for receiving the bag from the forming tube filled with product. There is means for delivering product into the forming tube, retracting the jaws and moving the bag downwardly into the shaping means. There is vibrating means adjacent the forming tube for vibrating the product while in the forming tube and if the level in the forming tube is such that when the bag is lowered into the shaping means, product would be situated between the jaws. The vibrating means operates to reduce the height of the product to a level such as to be below the jaws so that the bag can be sealed without interference from the product. In the aforesaid apparatus, the vibrating means is initiated by sensing means located adjacent the forming tube. The vibrating means aborts as soon as the level subsides to a level below the sensing means.

In accordance with the invention as herein illustrated, it has been found desirable, if there is an excess amount of product in the forming tube, on the one hand to continue operation of the vibrating means associated with the forming tube into the next cycle of operation in anticipation of an excess volume to reduce the product to a level below the jaws; or, on the other hand, if there is an excess volume of product in the forming tube, to move the bag into the shaping means filled with product and if the product is above the jaws, interrupting the cycle of operation and preventing the jaws from closing until vibration of the shaping means reduces product to a level below the jaws. Then, the bag can be sealed above the product. Optionally, the vibrating means may be operated continuously.

The present invention advantageously includes a sensor beneath the jaws so that vibration of the shaping means can be effectively used to settle product to a level which will not jam the jaws when they are engaged. The sensor reinitiates the cycle of operation when the product is at an acceptable level.

The invention will now be described in greater detail with reference to the accompanying drawings, wherein.

Figure 1:
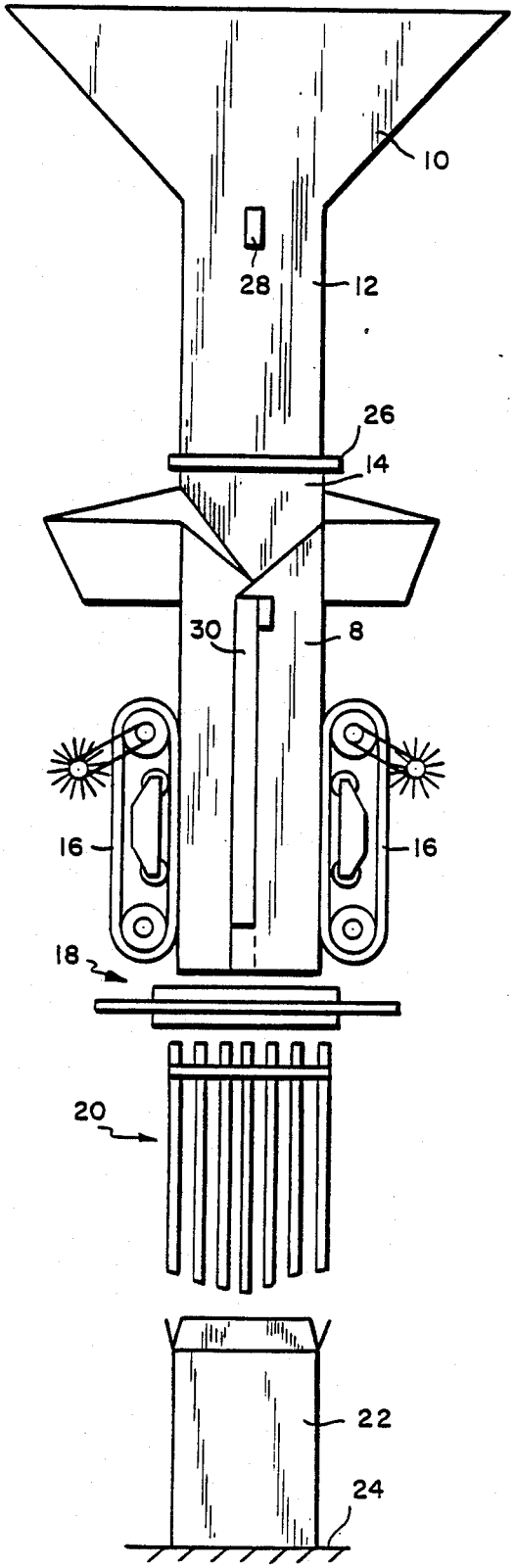
FIG. 1 is a diagrammatic front elevation of the forming machine according to one form of this invention.
Figure 2:
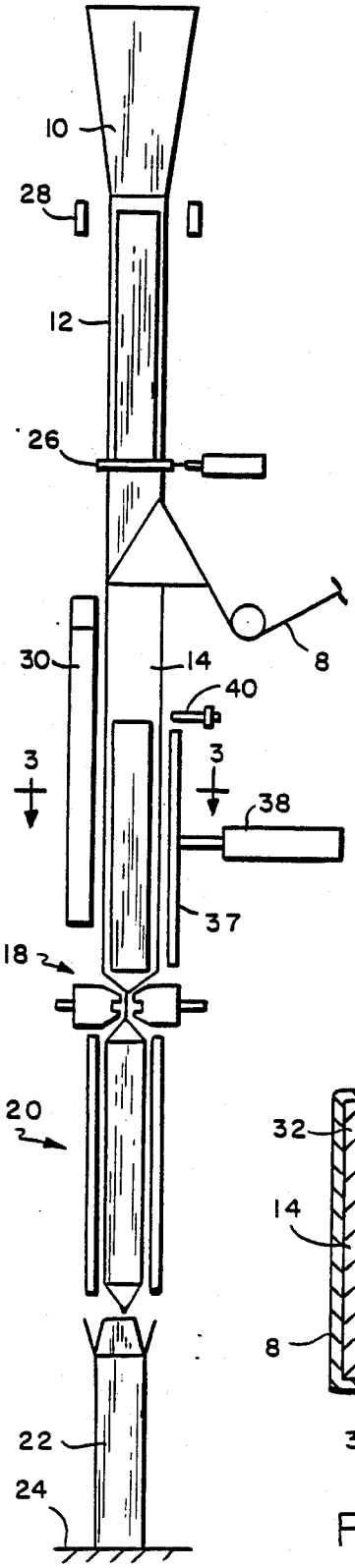
FIG. 2 is a diagrammatic side elevation of the forming machine shown in FIG. 1 as seen from the right-hand side.

Referring to the drawings, FIGS. 1 and 2, the forming apparatus in one form comprises a hopper 10, a measuring tube 12, a forming tube 14, feeding means 16—16 for moving bag forming material formed about the forming tube downwardly thereon to form a bag thereon, sealing and severing means in the form of jaws 18—18 for forming the bottoms and tops of successive bags and severing them one from another and shaping means 20 for confining the severed bags and guiding them into open-end cartons 22 resting on a support 24 which may, for example, be a conveyor for moving containers successively into position for receiving a filled and sealed bag and then moving it away to provide for moving a succeeding container into position.

The measuring tube 12 and forming tube 14 are of corresponding cross section and at the junction of the lower end of the measuring tube 12 and the upper end of the forming tube 14, there is a retractable closure gate 26. At the upper end of the measuring tube 12, there is a first sensing means 28 which detects the height of the product in the measuring tube.

Adjacent one side of the forming tube 14, there is a side sealing element 30 for forming a side seam as the bag forming material is drawn onto the forming tube 14 by the feeding means 16—16.

Figure 3:
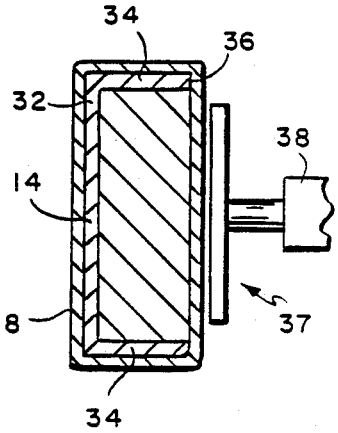
FIG. 3 is a horizontal section taken on the line 3—3 of FIG. 2.

The forming tube 14, as shown in cross section in FIG. 3, has a closed side 32, closed sides 34—34 and an open side 36. Adjacent the open side 36, there is a vibrator plate 37 disposed parallel to the open side, operable by suitable means 38 to repeatedly strike the unsupported side of the bag on the forming tube at the open side 36 at appropriate times as will be disclosed hereinafter.

There is also mounted, adjacent the open side 36 of the forming tube, a sensor 40, FIG. 2, which detects the upper level of the product within the forming tube 14.

Under normal operating conditions, the apparatus is operated cyclically to deliver a predetermined weight of product from the measuring tube 12 into the forming tube 14 upon which the bag forming material has been formed and sealed at its lower end by jaws 18—18, whereupon the jaws are retracted and the feeding means 16—16 is actuated to move a predetermined length of the formed bag downwardly between the retracted jaws into the shaping means 20. As the formed bag is moved downwardly, the product within the forming tube 14 gravitates from the forming tube 14 into the bag. When a predetermined length of bag has been moved downwardly, the feeding means 16—16 is aborted and the jaws 18—18 are reengaged to form the top seal for the filled bag and the bottom seal for the succeeding bag. The cyclical operation of the apparatus will continue so long as the level of the product when delivered into the forming tube 14 is below the sensor 40.

In accordance with this invention, in the event that the product when delivered into the forming tube 14 is at a level such as to block the sensor 40, the cycle of machine operation is interrupted and the sensor 40 will initiate operation of the vibrator plate 37 so as to effect vibration of the product in the forming tube 14. When the level of the product in the forming tube 14 is reduced to an extent to clear the sensor 40, the jaws 18—18 will be retracted, the bag moved down into the shaping means 20, and the jaws reengaged to form the top seal and to initiate the next cycle of operation. The vibrator plate 37 will continue to operate into the next cycle of operation. If the sensor 40 is not blocked in the next cycle, then it can be used to abort operation of the vibrator. The vibrator will thus continue to operate until after a cycle in which the filled bag of product in the forming tube does not block the sensor 40.

Figure 5:
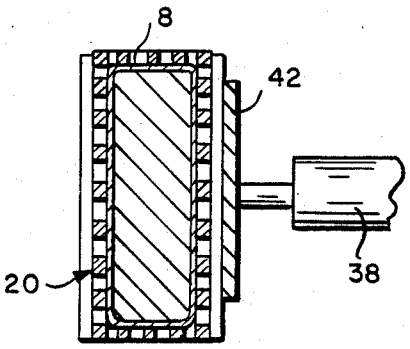
FIG. 5 is a section taken on the line 5—5 of FIG. 4.
Figure 4:
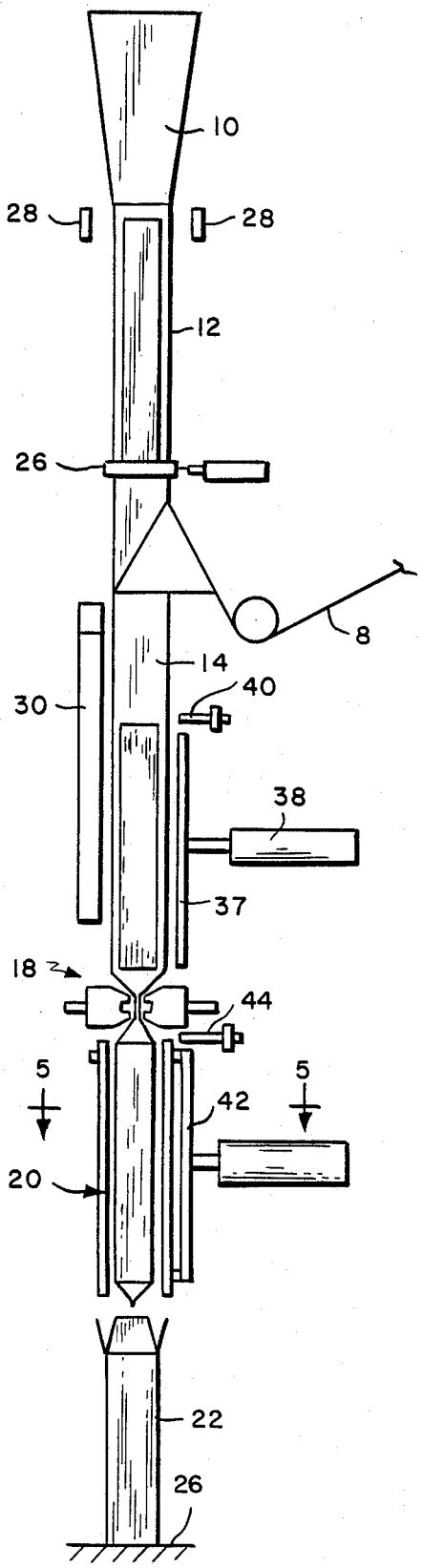
FIG. 4 is a diagrammatic side elevation of a modified form of the forming machine.

Alternatively, as shown in FIGS. 4 and 5, a second vibrator plate 42 is disposed adjacent the shaping means 20 and sensing means 44 are disposed below the jaws 18—18 and above the shaping means 20. The shaping means 20 is a rectangular array of rods for confining the shape of the bag so that it will fit easily into the carton 22 below. In the event that the product in the forming tube 14 is above the sensing means 40, operation of the vibrator plate 37 will be initiated. It may be desirable to limit the time during which a filled bag is held within the forming tube 14 and the cycle interrupted. At the end of the time limit or sooner if the product clears sensing means 40, the bag is lowered into the shaping means 20. If product in the bag in the shaping means 20 blocks the sensing means 44, the cycle of operation is interrupted and the jaws 18—18 are prevented from closing. Vibration of the vibrator plate 42 is initiated or in the alternative, the vibrator plate 42 operates continuously. The vibrator plate 42 shakes the shaping means 20 causing the product in the bag to vibrate and settle quickly below the maximum fill level. Since the whole bag is shaken by the vibrator plate 42 it is found to be more effective at settling product than the vibrator 37 which only acts upon the bag forming material and on only one side. The vibrator plate 42 will continue to operate until the level of the product in the bag subsides to a level below the sensing means 44 so that it clears the jaws, whereupon the jaws will be closed, the vibrator plate 42 stopped, and the cyclical operation resumed. In the alternative, the vibrator plate 42 can be continuously operated.

There are numerous combinations of ways to control the two vibrators with sensor 40, sensor 44 and a sensor 28 at the top of the measuring tube. One method is to continuously operate vibrator plate 37 and to operate vibrator 42 only when sensor 44 is blocked when a bag is in position inside the shaping means 20. Cyclical operation is interrupted only in response to sensor 44. An alternative is to provide sensor 40 with the ability to interrupt cyclical operation so as to hold a filled bag within the forming tube 14 until the product clears from the sensor 40 or until a predetermined time limit expires.

Another method of operation is to use sensor 28 to initiate operation of vibrator plate 37 against the sheet material adjacent the forming tube. This may be a desirable method when filling fragile product which may chip or crumble from excessive vibration. This method can limit operation of the vibrator plates to only when necessary to avoid jamming of the jaws 18 due to product in the sealing area. The filling apparatus under normal operating conditions fills successive predetermined lengths of bag with product without interruption.

A further option is to effect operation of both the vibrating means continuously.

The cycling of the feeding means 16—16, the sealing and severing means 18—18 and closure 26 are controlled by suitable cam-operated switches. Operation of the vibrator means 37 and 42 and interruption of a cycle are controlled by the sensing means 40 and 44.

It should be understood that the present disclosure is for the purpose of illustration only and includes all modifications or improvements which fall within the scope of the appended claims.

I claim:

1. Cyclically operable apparatus for forming and filling bags with product comprising:

a forming tube on which bag forming material is formed into a bag;

shaping means for confining the shape of a bag when it has been filled with product;

jaws situated between said forming tube and said shaping means for forming the lower and upper ends of successive bags formed on said forming tube;

means for delivering product into the forming tube;

means for lowering the bag forming material after a predetermined amount of product has been delivered so that the product held above the lower end of a bag is suspended in said shaping means;

sensing means disposed beneath said jaws for sensing the height of the product above the lower end of a bag to interrupt the cycle of operation if the height of the product exceeds a predetermined height; and vibrating means associated with said shaping means for causing the bag suspended within said shaping means to vibrate so as to promote settling of the product beneath said predetermined height.

2. The apparatus of claim 1 wherein said vibrating means operates continuously.

3. The apparatus of claim 1 wherein said sensing means is further operable to initiate operation of said vibrating means if the height of the product in the bag suspended in said shaping means exceeds the predetermined height.

4. The apparatus of claim 3 wherein said sensing means is operable to abort vibration, close the jaws and initiate the next cycle of operation when the level of the product in the bag suspended in said shaping means settles to a level below said predetermined height.

5. The apparatus of claim 1 further comprising bag forming material vibrator means adjacent an open side of said forming tube for vibrating said bag forming material.

6. The apparatus of claim 5 further comprising a measuring tube disposed above said forming tube for receiving a predetermined weight of product and second sensing means arranged adjacent said measuring tube operable in the event that the product in the measuring tube exceeds said predetermined height to initiate operation of said bag forming material vibrator means.

7. Cyclically operable apparatus for forming and filling bags with product comprising:

a forming tube;

means for forming sheet material into a tube about said forming tube;

sealing and severing means, located at the lower end of said forming tube for engaging the sheet material at predetermined intervals to form a sealed area transversely of the tube of sheet material and to sever the tube in said sealed area to form the top and bottom of successive bags;

means for delivering a predetermined amount of product into said forming tube;

first vibrating means disposed adjacent said forming tube for vibrating the sheet material;

first sensing means for sensing the level of product in the forming tube, operable if the height of the product in the forming tube exceeds a predetermined height to interrupt the cycle of operation for no more than a predetermined length of time;

shape retaining means disposed below said sealing and severing means to receive said tube of sheet material after it has been filled with said predetermined amount of product;

means for lowering the tube of sheet material about the forming tube into said shape retaining means after said predetermined amount of product is received in said tube of sheet material above said sealed area;

second vibrating means for shaking said shape retaining means to cause the product to settle within the tube of sheet material suspended within said shape retaining means; and second sensing means arranged below said sealing and seevering means operable in the event that the product in the tube of sheet material within said shape retaining means blocks said second sensing means to interrupt the cycle of operation and to prevent said sealing and severing means from engaging said tube of sheet material.

8. The apparatus of claim 7 wherein said first and second vibrating means operate continuously.

9. The apparatus of claim 7 wherein said first sensing means is further operable to initiate operation of said first vibrating means and if the height of the product in the forming tube exceeded a predetermined height in a cycle to continue operation of the vibrating means throughout the remainder of the cycle and into the next cycle.

10. Apparatus according to claim 9 wherein said first sensing means aborts operation of the first vibrating means if the product does not exceed said predetermined height in the next cycle of operation.

11. Apparatus according to claim 7 wherein one side of the forming tube contains an opening and the first vibrating means is situated in said opening.

12. The method of forming and filling bags with product comprising forming sheet material into a tube on a hollow forming tube with the aid of jaws, sealing the lower end of the tube to form a bag on the hollow forming tube, depositing a predetermined weight of product in the hollow forming tube, moving the bag downwardly from the hollow forming tube into shaping means, sensing the height of the product within the bag in the shaping means to determine if it exceeds a predetermined height, effecting vibration of the shaping means if said predetermined height is exceeded until the product contained in the bag subsides to a level not exceeding said predetermined height and when the level of the product in the bag within the shaping means subsides to said level, sealing the upper end of the bag.

* * * * *